US009351528B2

(12) United States Patent
Grimes et al.

(10) Patent No.: US 9,351,528 B2
(45) Date of Patent: May 31, 2016

(54) GARMENT WEIGHT CLIP

(71) Applicants: Steven L. Grimes, Chicago, IL (US); Soheila Mozzafar, Chicago, IL (US)

(72) Inventors: Steven L. Grimes, Chicago, IL (US); Soheila Mozzafar, Chicago, IL (US)

( * ) Notice: Subject to any disclaimer, the term of this patent is extended or adjusted under 35 U.S.C. 154(b) by 84 days.

(21) Appl. No.: 14/180,089

(22) Filed: Feb. 13, 2014

(65) Prior Publication Data

US 2015/0223534 A1 Aug. 13, 2015

(51) Int. Cl.
*A41F 17/02* (2006.01)

(52) U.S. Cl.
CPC ..... *A41F 17/02* (2013.01); *Y10T 24/44376* (2015.01); *Y10T 24/44402* (2015.01)

(58) Field of Classification Search
CPC ..... A47H 23/01; Y10S 24/13; Y10S 16/08; A41F 17/00; A47K 3/38; Y10T 24/3437; Y10T 24/3449
USPC ..... 24/3.11, 3.12, 499, 504, 516, 521
See application file for complete search history.

(56) References Cited

U.S. PATENT DOCUMENTS

| | | | | |
|---|---|---|---|---|
| 614,189 | A | | 11/1898 | Waitzfelder |
| 642,174 | A | | 1/1900 | Tingley |
| 724,518 | A | | 4/1903 | Sutton |
| 1,024,957 | A | | 4/1912 | Wein |
| 1,062,403 | A | | 5/1913 | Kahn |
| 1,082,208 | A | | 12/1913 | Munz |
| 1,388,802 | A | | 8/1921 | Cooper |
| 1,741,060 | A | | 12/1929 | Levenson |
| 1,755,291 | A | | 4/1930 | Fox |
| 1,815,006 | A | * | 7/1931 | Horsting et al. ..... 24/498 |
| 1,828,678 | A | | 10/1931 | Peterman et al. |
| 1,874,871 | A | | 8/1932 | Bower |
| 1,936,198 | A | | 11/1933 | Kirsch |
| 1,967,965 | A | * | 7/1934 | Morehouse et al. ..... 24/499 |
| 1,979,375 | A | * | 11/1934 | Fielding ..... 24/521 |
| 2,065,831 | A | | 12/1936 | Smith |
| 2,188,151 | A | * | 1/1940 | Marshall ..... 24/457 |
| 2,212,326 | A | | 8/1940 | Piken |
| 2,321,563 | A | | 6/1943 | Penley |
| 2,343,062 | A | * | 2/1944 | Kennison ..... 24/511 |
| 2,701,369 | A | | 2/1955 | Freid |
| 2,720,656 | A | | 10/1955 | Allan |
| 2,926,410 | A | * | 3/1960 | Normandin ..... 24/505 |
| 2,971,353 | A | * | 2/1961 | Germana ..... 63/14.7 |
| 2,983,926 | A | | 5/1961 | Turner |
| 3,107,361 | A | | 10/1963 | Glutting, Sr. |
| 3,107,405 | A | * | 10/1963 | Emmer ..... 24/3.8 |
| 3,131,449 | A | | 5/1964 | Chiyoichi |
| 3,158,011 | A | | 11/1964 | Carroll |
| 3,237,261 | A | | 3/1966 | Homonoff |
| 3,282,328 | A | | 11/1966 | Mushro et al. |

(Continued)

FOREIGN PATENT DOCUMENTS

WO WO8908341 A1 9/1989

OTHER PUBLICATIONS

International Search Report and Written Opinion for PCT/US2015/015323 dated Aug. 28, 2015 (11 pp.).

*Primary Examiner* — Victor Batson
*Assistant Examiner* — David Upchurch
(74) *Attorney, Agent, or Firm* — William J. Lenz, Esq.; Neal, Gerber & Eisenberg LLP

(57) ABSTRACT

A garment weight clip that suppresses unwanted movement of a garment, such as movement by a surge of air, and configured for discrete use.

19 Claims, 4 Drawing Sheets

(56) References Cited

U.S. PATENT DOCUMENTS

| | | | | | |
|---|---|---|---|---|---|
| 3,427,695 | A | * | 2/1969 | Cowan | 24/564 |
| 3,531,835 | A | * | 10/1970 | Paikin | 24/516 |
| 3,802,032 | A | * | 4/1974 | Weed | 24/66.13 |
| 3,956,805 | A | * | 5/1976 | Stroh | 24/505 |
| 4,188,799 | A | | 2/1980 | Saccoccio | |
| 4,277,864 | A | * | 7/1981 | Orson, Sr. | 24/327 |
| 4,574,595 | A | | 3/1986 | Moody | |
| 4,707,906 | A | * | 11/1987 | Posey | 29/453 |
| 4,723,326 | A | | 2/1988 | Tarlow et al. | |
| 5,007,139 | A | | 4/1991 | Ahern | |
| D374,170 | S | | 10/1996 | Slaski | |
| 5,644,823 | A | * | 7/1997 | Montaquila | 24/499 |
| 5,894,043 | A | | 4/1999 | Sood | |
| 5,979,021 | A | | 11/1999 | Swift | |
| 6,041,454 | A | | 3/2000 | Summerford | |
| 6,425,167 | B1 | | 7/2002 | Barbarite et al. | |
| 6,804,866 | B2 | * | 10/2004 | Lemke et al. | 24/338 |
| 7,337,501 | B2 | * | 3/2008 | Vermillion | 24/3.12 |
| 8,574,027 | B2 | | 11/2013 | Kipnes | |

* cited by examiner

GARMENT WEIGHT CLIP

TECHNICAL FIELD

This disclosure relates to a weighted clip, and more particularly, to a weighted clip for use with a garment to aid in preventing a garment from unwanted movement.

BACKGROUND

Many garments, such as skirts, dresses, or the like, feature a loose-fitting or free-flowing element, particularly at the bottom portion of the garment. While these elements provide a certain amount of desirable stylistic movement, they also increase the chance for undesirable movement. For example, when a sudden or sustained surge of air is encountered, such as a gust of wind or sustained winds, the bottom of the garment may invert or flip upwards, causing the wearer embarrassment or other distress. Such air conditions are often unpredictable. Sustained winds can make keeping a garment from inverting difficult and distracting.

Some known devices are primarily intended to be ornamental in nature and used overtly with the garment. Depending on the aesthetics of the device, it may not be suitable as a fashion accessory. Other known devices utilize free-hanging weights on either the exterior side or the interior side of the garment, which can cause irritation to the user through additional movement. Yet other known devices utilize attachment methods that can cause permanent damage or excessive wear and tear to the material of the garment, or unsightly puckering or wrinkling of the garment. And other known approaches involve sewing weights into the hem of a skirt or dress, which permanently alters the skirt and can cause excessive wear and tear on the garment. These weights are also not easily removable for washing or for occasions where they are not needed.

Based on these and other shortcomings of known devices, a need exists for a device that suppresses the inversion of any garment under conditions where a surge of air may occur, and where its use can be concealed or otherwise used discretely, does not deform the garment, does not cause permanent damage or excessive wear and tear to the garment, requires minimal effort, can be easily employed in a public setting, and is not irritating or uncomfortable to wearer.

The invention(s) described herein is/are directed, but not limited, to addressing these and other issues associated with existing devices and methods of use. Other aspects and benefits not related to these issues are contemplated as well.

SUMMARY

A weighted clip, which may be used with a garment, comprises a receiver, a clip lever and a weight. The receiver comprises a first portion and a second portion defining a gap therebetween and an associated receiver opening. The receiver opening includes an insertion end to accept a portion of material to which the clip will be attached. The clip lever is movably connected to the receiver and is biased by a biasing mechanism into a closed position wherein at least a portion of the clip lever is disposed adjacent to the receiver to allow the clip lever to engage the portion of material to which the clip will be attached. The weight is connected to one of either the receiver or the clip lever.

According to a particular aspect, the gap extends from the insertion end of the receiver opening beyond a portion of the receiver to which the clip lever is connected, which allows the material to be inserted into the gap beyond this portion to minimize the clip extending beyond an edge or hem of a garment.

According to another aspect, the weight is removably connected to one of either the receiver or the clip lever, thereby facilitating interchangeability of weight styles, types, sizes and amounts.

According to yet another aspect, the first portion of the receiver is longer than the second portion of the receiver, and the clip lever is biased into the closed position against the first portion of the receiver, thereby facilitating engagement of the material from its opposing sides and minimizing puckering or other deformation of the material.

According to yet another aspect, the receiver is made of a generally transparent material, thereby facilitating discrete use of the clip.

These and other aspects will become readily apparent from the written specification, drawings, and claims provided herein.

DETAILED DESCRIPTION OF EXEMPLARY EMBODIMENTS

Figure 1:
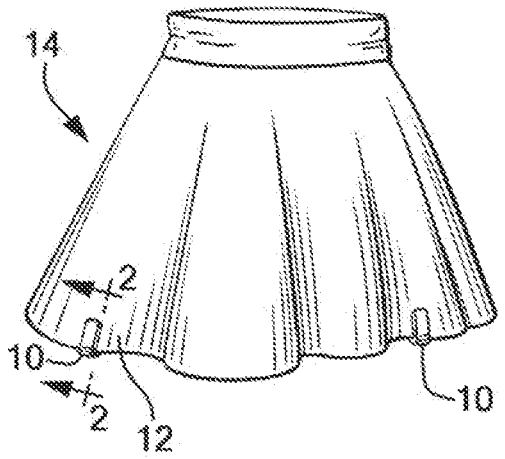
FIG. 1 is a perspective view of a garment, specifically a skirt, having two weight clips attached thereto in accordance with one or more aspects described herein.

The description that follows describes, illustrates and exemplifies one or more particular embodiments of the invention(s) in accordance with its principles. This description is not provided to limit the invention(s) to the embodiments described herein, but rather to explain and teach the principles of the invention(s) in such a way to enable one of ordinary skill in the art to understand these principles and, with that understanding, be able to apply them to practice not only the embodiments described herein, but also other embodiments that may come to mind in accordance with these principles. The scope of the invention(s) is/are intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates the didactic purpose of the specification. Additionally, the drawings set forth herein are not necessarily drawn to scale, and in some instances proportions may have been exaggerated to more clearly depict certain features. Such labeling and drawing practices do not necessarily implicate an underlying substantive purpose. Furthermore, one or more drawings herein may be of a purely functional schematic nature, or a combination of a functional and structural/hardware schematic nature, intended to disclose and teach functional aspects of the subject matter without necessarily limiting the disclosure to any specific structure/hardware. As stated above, the present specification is intended to be taken as a whole and interpreted in accordance with the principles of the invention(s) as taught herein and understood to one of ordinary skill in the art.

Figure 9A:
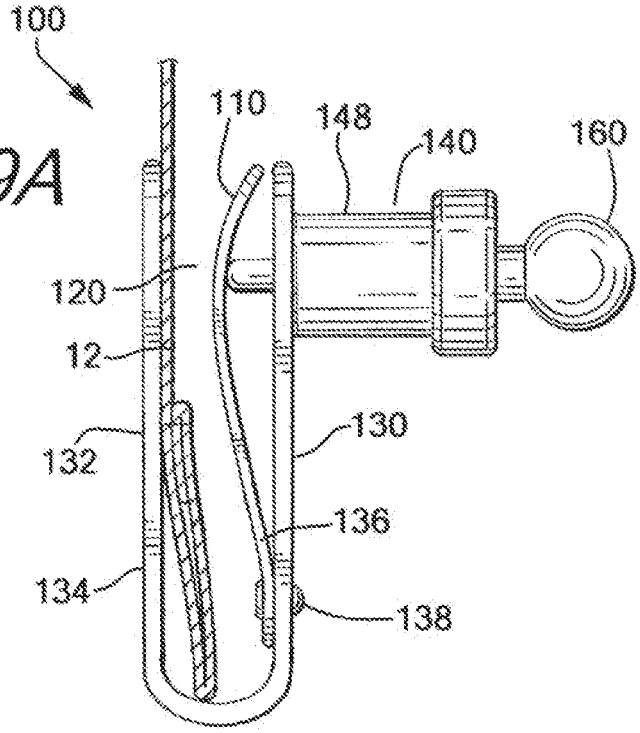
FIG. 9A is a side view of another embodiment of a weight clip shown in an open position with respect to a garment shown in partial cross-section for reference purposes in accordance with one or more aspects described herein.
Figure 9B:
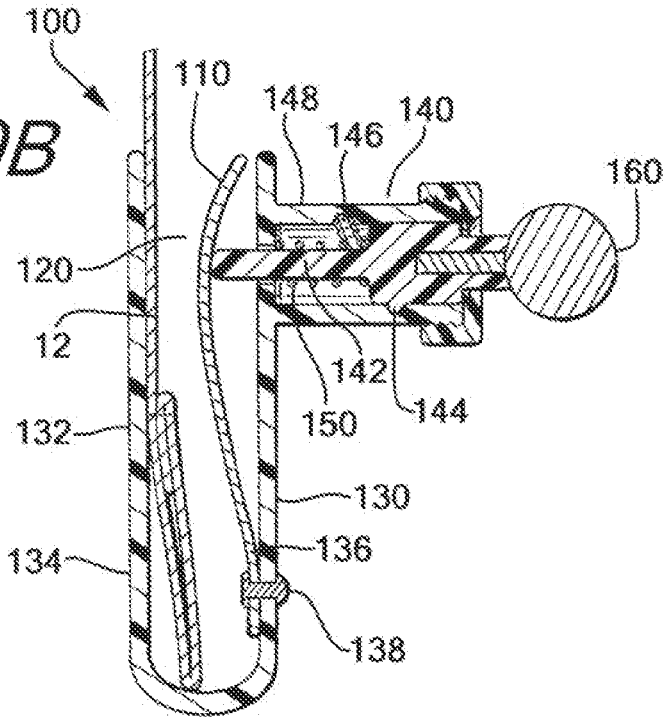
FIG. 9B is a cross-sectional view of the weight clip of FIG. 9A in an open position in accordance with one or more aspects described herein.
Figure 10A:
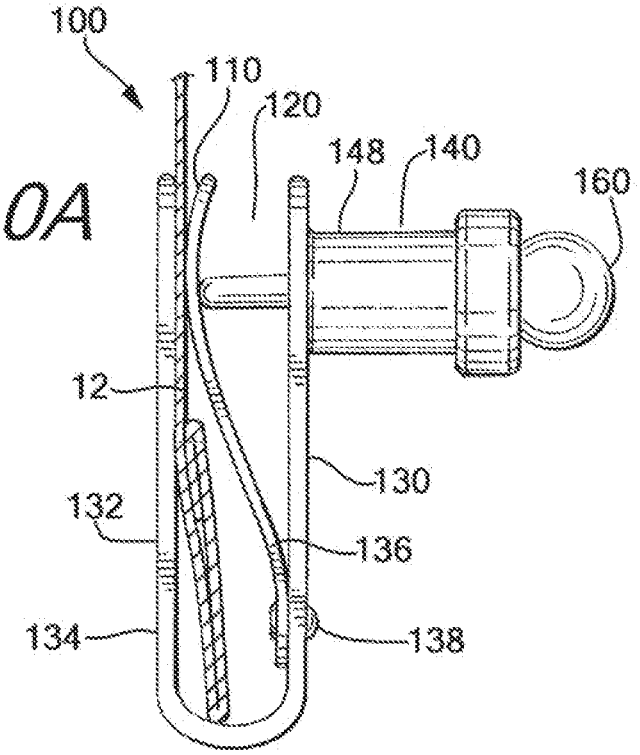
FIG. 10A is a side view of the embodiment of the weight clip shown in FIG. 9A shown it a closed position with respect to a garment shown in partial cross-section for reference purposes in accordance with one or more aspects described herein.
Figure 10B:
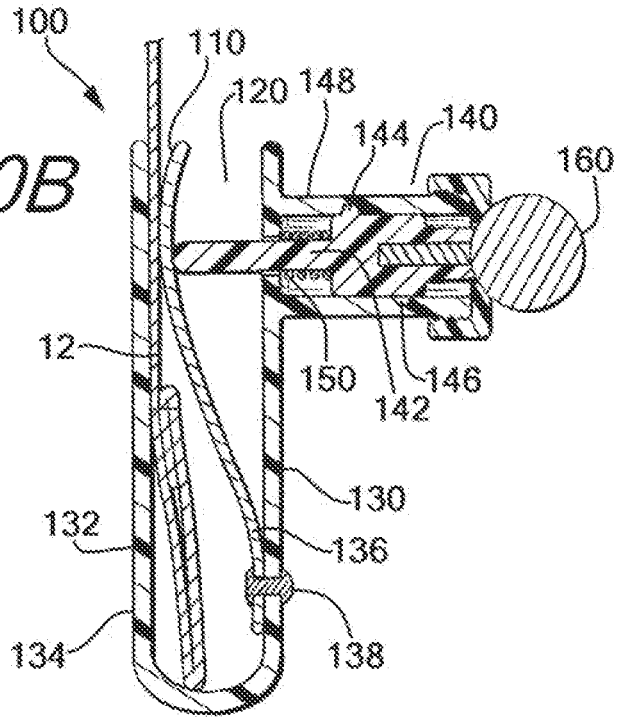
FIG. 10B is a cross-sectional view of the weight clip of FIG. 10A in a closed position in accordance with one or more aspects described herein.

FIG. 1 illustrates an exemplary intended use of a weight clip in accordance with one or more principles described herein. As shown in FIG. 1, a pair of weight clips 10 are shown in a particular embodiment and attached to a hem or edge portion of material 12 of a garment 14 in the form of a skirt. As will be described in more detail, the clips 10 engage the portion of material 12 in a discrete fashion while providing weight to the portion of material to aid in preventing undesirable movement of the garment 14. FIGS. 2 and 4-6 illustrate in more detail an embodiment of the weight clip 10 in engagement with the portion of material 12. FIGS. 9 and 10 illustrate an additional embodiment of a weight clip, which will be described in more detail herein after the description of the embodiment shown in FIGS. 2-6.

Figure 2:
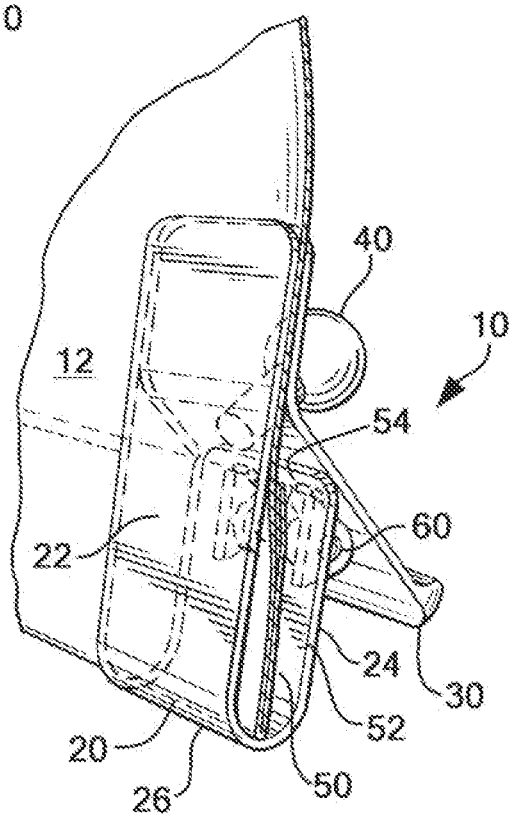
FIG. 2 is a partial perspective view of one of the weight clips in FIG. 1 attached to the garment in cross-section taken along section line 2-2 in FIG. 1 in accordance with one or more aspects described herein.
Figure 3:
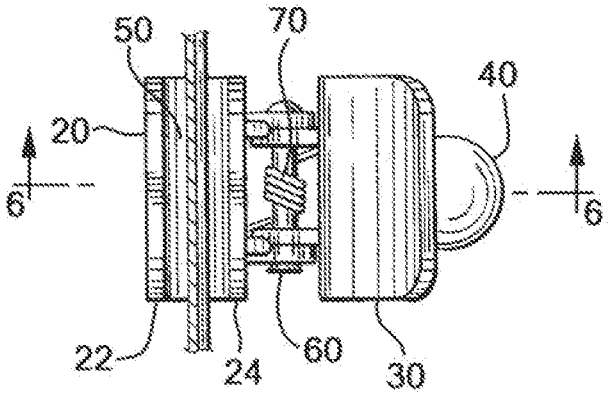
FIG. 3 is an end view of an embodiment of a weight clip in an open position and showing a partial cross-section of the garment material for reference purposes in accordance with one or more aspects described herein.

Referring generally to FIGS. 2-6, and more specifically to FIGS. 2 and 3, the clip 10 comprises a receiver 20, a clip lever 30 and a weight 40. The receiver 20 comprises a first portion 22 and a second portion 24 defining a gap 50 therebetween and an associated receiver opening 52. The receiver opening 52 includes an insertion end 54 to accept the portion of material 12 to which the clip 10 will be attached. The clip lever 30 is movably connected to the receiver 20 and is biased by a biasing mechanism 70 into a closed position wherein at least a portion of the clip lever 30 is disposed adjacent to the receiver 20 to allow the clip lever 30 to engage the portion of material 12 to which the clip 10 will be attached. As shown in this particular embodiment, the clip lever 30 is pivotably connected to the receiver 20 to define a fulcrum 60 and the clip lever 30 is disposed adjacent the receiver opening 52 when in the closed position. In some embodiments, the biasing mechanism 70 is a spring, which is shown in the embodiment in the figures. In other embodiments, the biasing mechanism 70 may be a flexible or resilient portion of either one of the receiver 20 or the clip lever 30 integrally formed therein and providing a biasing force. In the embodiment shown in FIGS. 2-6, the fulcrum 60 may be defined by a variety of configurations to facilitate the pivotable connection, such as a cylindrical pin and support bushing arrangement between the receiver 20 and the clip lever 30.

Figure 4:
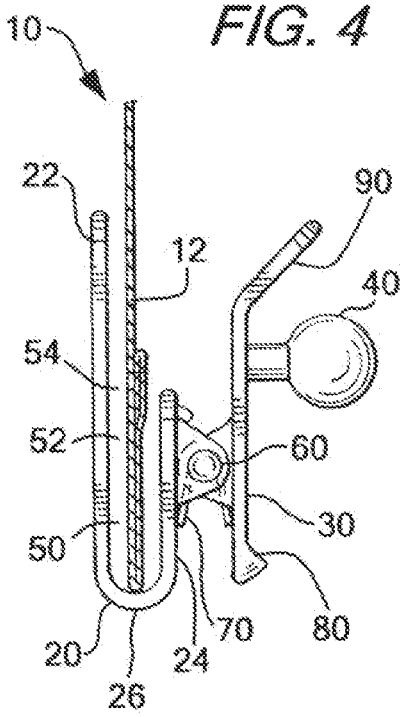
FIG. 4 is a side view of an embodiment of a weight clip shown in an open position with respect to a garment shown in partial cross-section for reference purposes in accordance with one or more aspects described herein.
Figure 5:
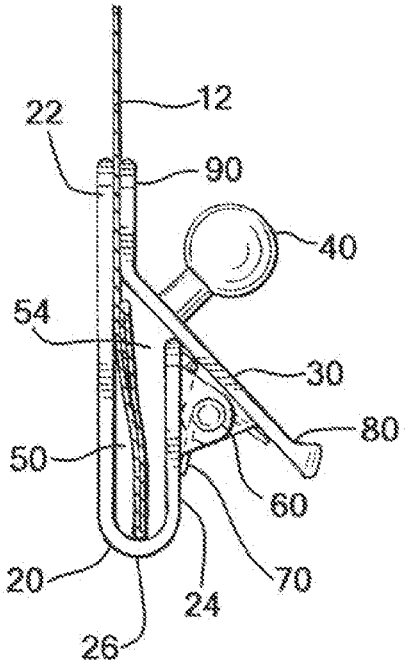
FIG. 5 is a side view of an embodiment of a weight clip shown in a closed position with respect to a garment shown in partial cross-section for reference purposes in accordance with one or more aspects described herein.
Figure 6:
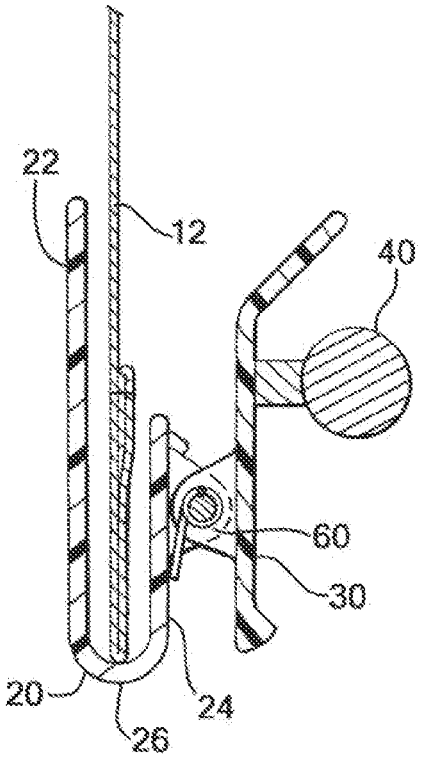
FIG. 6 is a cross-sectional view taken along section line 6-6 in FIG. 3 of the embodiment of the weight clip shown FIG. 3 in an open position with respect to a garment shown in partial cross-section for reference purposes in accordance with one or more aspects described herein.

In the embodiment shown in FIGS. 2-6, the first portion 22 and the second portion 24 of the receiver 20 are connected at an end 26 opposing the insertion end 54 and together define a generally U-shaped configuration of the receiver 20. In the embodiment shown, the first portion 22 of the receiver 20 is longer than the second portion 24 of the receiver 20, which facilitates the ability of the clip lever 30 to engage the first portion 22 of the receiver 20 in a closed position such as is shown in FIGS. 2 and 5.

Figure 7:
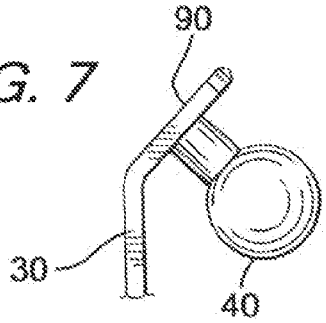
FIG. 7 is a partial view of an alternate embodiment of a clip lever and weight portion of the weight clip in accordance with one or more aspects described herein.
Figure 8:
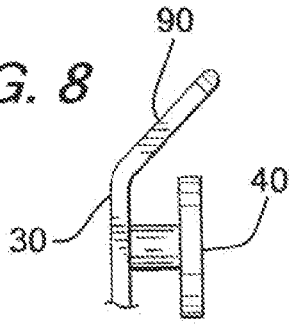
FIG. 8 is a partial view of an alternate embodiment of a clip lever and weight portion of the weight clip in accordance with one or more aspects described herein.

As shown in FIGS. 2-8, the weight 40 is connected to the clip lever, but in other embodiments, the weight 40 may be connected to the receiver 20. In some embodiments, the weight 40 may take the form of different shapes, types, amounts or sizes and may be removable to allow changing of weights to suit various conditions or comfort of the garment wearer. In some embodiments, the weight may be integral to or otherwise embedded in the receiver 20 or clip lever 30 as applicable. In embodiments where the weight 40 is removable, the weight may have a threaded or snap mechanism engagement to the receiver 20 or clip lever 30 as applicable. In other embodiments, the weight 40 may be removably connected via a magnetic attachment. As shown in FIG. 7, in a particular embodiment, the weight 40 may be of a spherical shape and may include a stem attachment to the clip lever 30 near the end of the load arm 90 of the clip lever 30. As shown in FIG. 8, in another embodiment, the weight 40 has a lower profile disc-like shape and may include a stem attachment to the clip lever 30 at a location other than near the end of the load arm 90 of the clip lever 30. In some embodiments, the weight may have a more flush attachment or connection to the receiver 20 or clip lever 30 as applicable. As previously stated, and as should be understood, any number of shapes, sizes and configurations of weights may be utilized to provide the desired weight, comfort and functionality to the garment wearer.

To enhance discreteness of use of the clip 10, in certain embodiments, the receiver 20 is made from a transparent or translucent material. In other embodiments, the receiver 20 may be made available in a variety of colors. In certain embodiments, the clip 10 or one or more of the receiver 20 and clip lever 30 may be made from a suitable thermoplastic or thermoset polymer material. In some embodiments, the clip 10 or one or more of the receiver 20 and clip lever 30 may be made from an acrylic material.

With reference to FIG. 4, the portion of material 12 can be inserted into the gap 50 of the receiver when the clip 10 is in an open position. The open position may be achieved by application of force to a force arm 80 of the clip lever 30 to overcome a biasing force of the biasing mechanism 70, which maintains the clip lever 30 in a normally closed position. In the open position, the portion of material 12 may be inserted into the gap 50 via the insertion end 54 of the receiver opening 52. With reference to FIG. 5, the portion of material 12 is engaged by a load arm 90 of the clip lever 30 in the closed position. The closed position is achieved by removal of force from the force arm 80 of the clip lever to allow the biasing force of the biasing mechanism 70 to return the clip lever 30 to its normally closed position.

As can be seen in FIGS. 2 and 4-6, the position of the fulcrum 60 on the second portion 24 of the receiver 20 allows the portion of material 12 to be inserted beyond the position of the fulcrum 60 with respect to the receiver 20. This allows the portion of material 12 to be fully inserted into the clip 10 which then minimizes the clip 10 extending beyond the edge or hem of the portion of material 12. This also facilitates a substantially flat engagement of the portion of material 12 from its opposing sides by the first portion 22 of the receiver 20 and the load arm 90 of the clip lever 30, which minimizes puckering or other deformation of the material.

An additional embodiment of a clip in accordance with one or more aspects described herein is illustrated in FIGS. 9 and 10 as clip 100. In this embodiment, a clip lever 110 is disposed within a gap 120 defined by a first portion 130 and a second portion 132 of a receiver 134 and movably connected to the first portion of the receiver 134. The movable connection is facilitated by fixedly connecting the clip lever 110 at or adjacent to one end 136 to create a cantilever-like configuration that allows at least a portion of the clip lever 110 to engage a portion of material 12 to which the clip 110 will be attached when biased or moved into the closed position. In this embodiment, a rivet, pin, weld or other fastener 138 fixedly connects the end 136 of the clip lever 110 to the receiver. The clip lever 110 is selectively biased or moved into the closed position by a user via a mechanical lock 140. In this particular embodiment, the mechanical lock comprises a follower 142 having a pin or continuous protrusion 144 that engages a slot or channel 146 in a lock housing 148 in a cam-type arrangement to allow the follower 142 to move against the clip lever 110 and bias the clip lever 110 into the closed position when the follower 142 is turned by a user. A biasing mechanism 150 provides a biasing force against which the follower 142 can be moved. A detent (not shown) may be provided to retain the follower in a locked or closed position as shown in FIG. 10. In the closed position, the clip lever 110 engages the portion of the material 12 to which the clip 100 will be attached. In this embodiment, a weight 160 is integrated into the mechanical lock 140, but the weight 160 can be integrated with or otherwise connected to any part of the clip 100. In some embodiments, the weight 160 is removable and interchangeable with other weights. In some embodiments, the weight may be of different sizes or shapes. In some embodiments, the mechanical lock 140 is assembled to the receiver 134, such as by threaded engagement, for example. In other embodiments, the lock housing 148 of the mechanical lock 140 is integrally formed with the receiver 134. It should be understood that other mechanisms for displacing the clip lever 110 into the closed position are contemplated as well. As with some other embodiments, in the embodiment shown in FIGS. 9 and 10, the clip 100 allows the material to be inserted fully into the gap 120 to minimize the clip 100 extending beyond an edge or hem of the material.

While one or more specific embodiments have been illustrated and described in connection with the invention(s), it is understood that the invention(s) should not be limited to any single embodiment, but rather construed in breadth and scope in accordance with recitation of the appended claims.

What is claimed is:

1. A weighted clip comprising:

a receiver having a first portion and a second portion defining a gap therebetween and an associated receiver opening having an insertion end to accept a portion of material to which the clip will be attached;

a clip lever movably connected to the receiver and biased by a biasing mechanism into a closed position wherein at least a portion of the clip lever is disposed adjacent to the receiver to allow the clip lever to engage the portion of material to which the clip will be attached, wherein the clip lever is positioned outside of the gap; and a user attachable and removable weight connected to one of either the receiver or the clip lever.

2. The clip of claim 1, wherein the gap extends from the insertion end of the receiver opening to an opposing end of the receiver beyond a portion of the receiver where the clip lever is moveably connected to the receiver.

3. The clip of claim 1, wherein the clip lever is connected to an outer surface of the receiver.

4. The clip of claim 1, wherein the first portion and the second portion of the receiver are connected at an end opposing the insertion end and together define a generally U-shaped configuration of the receiver.

5. The clip of claim 1, wherein the biasing mechanism is a spring.

6. The clip of claim 1, wherein the biasing mechanism is a mechanical lock.

7. The clip of claim 1, wherein the receiver is made of a generally transparent material.

8. The clip of claim 1, wherein the first portion of the receiver is longer than the second portion of the receiver.

9. The clip of claim 8, wherein the clip lever is biased into the closed position against the first portion of the receiver.

10. The clip of claim 9, wherein the clip lever is pivotably connected to an outer surface of the second portion of the receiver.

11. A weighted clip comprising:

a receiver having a first portion and a second portion extending from an end of the receiver and offset from each other to define a gap therebetween, the receiver having an insertion opening to the gap adjacent a terminating end of at least one of the first and second portions to accept a portion of material to which the clip will be attached;

a clip lever moveably connected to an outside surface of the receiver and biased by a biasing mechanism into a closed position wherein at least a portion of the clip lever is disposed adjacent to one of either the first portion or the second portion of the receiver to allow the clip lever to engage the portion of material to which the clip will be attached, wherein the clip lever is positioned outside of the gap; and a weight connected to one of either the receiver or the clip lever.

12. The clip of claim 11, wherein the gap extends from the insertion end of the receiver opening to an opposing end of the receiver beyond a portion of the receiver where the clip lever is moveably connected to the receiver.

13. The clip of claim 11, wherein the weight is removable from and attachable to the one of either the receiver or the clip lever by a user of the clip.

14. The clip of claim 11, wherein the biasing mechanism is a spring.

15. The clip of claim 11, wherein the biasing mechanism is a mechanical lock.

16. A weighted clip comprising:

a receiver having a first portion and a second portion extending from an end of the receiver and offset from each other to define a gap therebetween, the receiver defining an insertion opening to the gap adjacent a terminating end of the second portion to accept a portion of material to which the clip will be attached;

a resilient clip lever positioned inside the gap and fixedly connected to the receiver;

a mechanical lock connected to the receiver, the mechanical lock flexing the clip lever from an open position wherein the clip lever is spaced from the second portion of the receiver, into a closed position wherein a portion of the clip lever is biased against the second portion of the receiver adjacent the insertion opening to allow the portion of the clip lever to engage the portion of material to which the clip will be attached; and a weight connected to the receiver.

17. The clip of claim 16, wherein the mechanical lock comprises a follower which contacts a portion of the clip lever.

18. The clip of claim 17, wherein the follower passes through the first portion of the receiver.

19. The clip of claim 16, where in the weight is selectively attachable and removable to the receiver by a user of the clip.

* * * * *